United States Patent [19]

Grobler

[11] Patent Number: 4,681,036

[45] Date of Patent: Jul. 21, 1987

[54] DELAY STARTERS

[75] Inventor: Jan H. A. Grobler, Wellington, South Africa

[73] Assignee: Bintech (PTY) Ltd., South Africa

[21] Appl. No.: 816,854

[22] Filed: Jan. 7, 1986

[51] Int. Cl.[4] ..... C06C 5/06; F42B 3/10

[52] U.S. Cl. ..... 102/275.3; 102/275.12

[58] Field of Search ..... 102/275.3, 275.4, 275.5, 102/275.6, 275.7, 275.9, 275.11, 275.12, 275.8; 149/19.2

[56] References Cited

U.S. PATENT DOCUMENTS

| | | | |
|---|---|---|---|
| 2,587,694 | 3/1952 | Chalmers et al. | 102/275.4 |
| 2,952,206 | 9/1960 | Beckstead | 102/275.7 |
| 3,020,844 | 2/1962 | Miller | 102/275.4 |
| 3,205,818 | 9/1965 | Coulson | 102/275.4 |
| 3,306,201 | 2/1967 | Noddin | 102/275.3 |
| 4,080,902 | 3/1978 | Goddard et al. | 102/275.8 X |
| 4,139,404 | 2/1979 | Goddard et al. | 149/19.2 |
| 4,215,631 | 8/1980 | Rucker | 102/275.2 |
| 4,314,508 | 2/1982 | Love | 102/275.3 X |

FOREIGN PATENT DOCUMENTS

| | | | |
|---|---|---|---|
| 499514 | 1/1954 | Canada | 102/275.3 |

*Primary Examiner*—David H. Brown
*Attorney, Agent, or Firm*—Larson and Taylor

[57] ABSTRACT

A delay starter device includes an elongated cylindrical member; a slow combustible material provided in the cylindrical member; and a highly combustible material provided at at least one position in or on the cylindrical member. The highly combustible material is adapted to be placed in contact with a fuse cord, and is further adapted to be ignited by the slow combustible material and in turn is adapted to ignite a fuse cord when in contact with it.

5 Claims, 4 Drawing Figures

DELAY STARTERS

FIELD OF INVENTION

The present invention relates to delay starters.

BACKGROUND TO INVENTION

Delay starters are used in explosive ignition systems, in particular in mining operations.

Often human lifes may be endangered if an explosive charge is ignited too early, too late or even not at all. It therefore is important that such delay starters operate accurately and effectively.

It is an object of the invention to suggest an improved type of delay starter.

SUMMARY OF INVENTION

According to the invention, a delay starter device includes an elongated cylindrical member of a non-explosive material; a slow combustible non-explosive material provided within the cylindrical member; and a hollow tube of highly combustible non-explosive material, provided in at least one position in the cylindrical member, for receiving a fuse inserted thereinto, such that said combustible material can be ignited by the slow combustible material and can in turn ignite a fuse when in contact with the fuse.

The highly combustible material may be provided at one end of the cylindrical member.

The tube of highly combustible material may extend transversely through the elongated cylindrical member.

The tube may be made of highly combustible material comprising a hard wax mixture.

The tube may be made of highly combustible material comprising a mixture of potassium permanganate and wax.

BRIEF DESCRIPTION OF DRAWINGS

The invention will now be described by way of example with reference to the accompanying schematic drawings.

In the drawing there is shown in

DETAILED DESCRIPTION OF DRAWINGS

Figure 1:
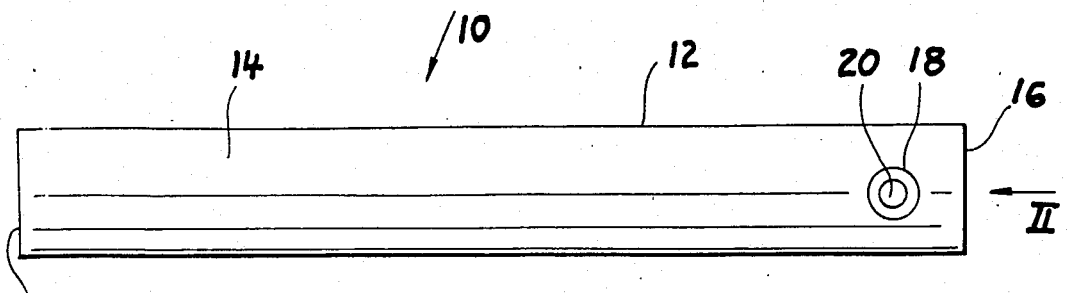
FIG. 1 a side view of a delay starter device in accordance with the invention.
Figure 2:
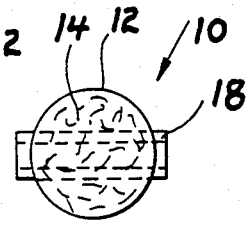
FIG. 2 an end view of the device seen along arrow II in FIG. 1.

Referring to FIGS. 1 and 2, the delay starter 10 is in the form of a stick or cylindrical member having an outer tubular sleeve 12 (eg. made of paper and thus being non-explosive) which is filled inside with slowly combustible material 14 (such as cotton wool and thus being non-explosive).

At one end 16 of the sleeve 12 a highly combustible member in the form of a tube 18 is provided. This tube 18 has a central hole 20 into which an ignitor cord can be inserted.

In use the delay starter is ignited at the end 22, which is opposite to the end 16. The starter then smoulders slowly until it reaches the member 18. The member 18 thereupon ignites rapidly and causes ignition of the ignitor cord inside it. The igniter cord thereafter burns up to the explosives for ignition and explosion thereof.

Figure 3:
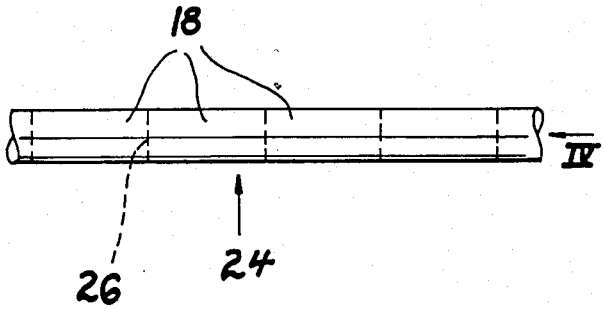
FIG. 3 a side view of the highly combustible member used in the delay starter device in accordance with the invention.
Figure 4:
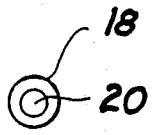
FIG. 4 an end view seen along arrow IV in FIG. 1.

Referring to FIGS. 3 and 4 a tube 24 is shown which comprises individual pieces 18 which are separable by breaking off at weakened zones 26. The pieces 18 are broken off and are inserted into the delay starter device 10 as may be required. The tube 24 is made of a hard wax mixture containing potassium permanganate material, a non-explosive material.

I claim:

1. A delay starter device, said device comprising an elongated cylindrical member of non-explosive material; a slow combustible non-explosive material provided in the cylindrical member; and a hollow tube of highly combustible non-explosive material, provided in at least one position in the cylindrical member and being adapted to receive a fuse cord inserted thereinto, for igniting by the slow combustible material and for, in turn, providing ignition of a fuse cord when in contact therewith.

2. A device as claimed in claim 1, in which the tube of highly combustible material is provided at one end of the cylindrical member.

3. A device as claimed in claim 1, in which the tube of highly combustible material extends substantially transversely through the elongated cylindrical member.

4. A device as claimed in claim 1, in which the tube is made of highly combustible material comprising a hard wax mixture.

5. A device as claimed in claim 1, in which the tube is made of highly combustible material comprising a mixture of potassium permanganate and wax.

* * * * *